United States Patent [19]

Tamura

[11] 4,202,302

[45] May 13, 1980

[54] AUTOMATIC CHOKE ARRANGEMENT

[75] Inventor: Tetsuomi Tamura, Toyota, Japan

[73] Assignee: Toyota Jidosha Kogyo Kabushiki Kaisha, Toyota, Japan

[21] Appl. No.: 971,212

[22] Filed: Dec. 20, 1978

[30] Foreign Application Priority Data

Jul. 28, 1978 [JP] Japan ..... 53-092170

[51] Int. Cl.[2] ..... F02M 1/10

[52] U.S. Cl. ..... 123/119 F; 261/39 B; 261/64 C

[58] Field of Search ..... 123/119 F; 261/39 A, 261/39 B, 64 B, 64 C

[56] References Cited

U.S. PATENT DOCUMENTS

| | | | |
|---|---|---|---|
| 3,791,358 | 2/1974 | Masaki | 123/119 F |
| 4,005,693 | 2/1977 | Masaki | 123/119 F |
| 4,060,062 | 11/1977 | Tsutsui | 123/119 F |

*Primary Examiner*—Ronald H. Lazarus

*Attorney, Agent, or Firm*—Brisebois & Kruger

[57] ABSTRACT

An automatic choke in which the choke valve is urged by a spring and can be closed at a temperature lower than a set value and opened at a temperature higher than the set value by by a choke-return diaphragm. The diaphragm is actuated by intake vacuum in response to operation of a temperature-sensing valve, thereby eliminating an expensive bi-metal unit, or a manual control to close the choke valve at the time of start-up.

13 Claims, 6 Drawing Figures

AUTOMATIC CHOKE ARRANGEMENT

BACKGROUND OF THE INVENTION

1. Field of the Invention:

The present invention relates to an automatic choke in an automobile engine or other engine.

2. Description of the Prior Art:

Manual chokes and automatic chokes have long been available, but recently the latter are favored for reasons of market demand, and reliability for anti-emission.

Even the automatic choke, however, has various troubles. First, the cost is high. Next, the control mechanism is complicated and if the opening and closing of the choke valve are controlled only by the engine performance, the exhaust gas becomes uncontrollable for anti-emission; and accordingly installation of both a choke breaker and a choke opener becomes necessary to assure both drivability and controllability of exhaust gas. Moreover on account of the presence of the choke breaker and the choke opener in addition to a bimetal means to open and close the choke valve, the range of temperature control is limited and the effect of the expensive bimetal means provided for control of this range is lost.

SUMMARY OF THE INVENTION

The primary object of the present invention is to liquidate the above-mentioned troubles and specifically to provide an automatic choke for an engine which is made cheaper than the conventional one because it eliminates the bimetal means.

Another object of the present invention is to provide a choke in which the mechanism is simplified through substantial use of the mechanism of the conventional manual choke which retains the merits of an automatic choke for the user, because he is not required to manually close the choke valve for startup.

Still another object of the present invention is to provide a choke which assures proper choke action for drivability with the use of a spring and a temperature-sensing valve instead of an expensive bimetal means.

Still another object of the present invention is to provide a choke which permits use of both a choke breaker and a choke opener, and yet assures good drivability together with conformity to exhaust gas control standards and prevention of overheating in the exhaust system.

Other objects of the present invention will become apparent from the following description of its preferred embodiments.

DETAILED EXPLANATION OF PREFERRED EMBODIMENTS

A first embodiment of a choke of the present invention will now be described.

Figure 1:
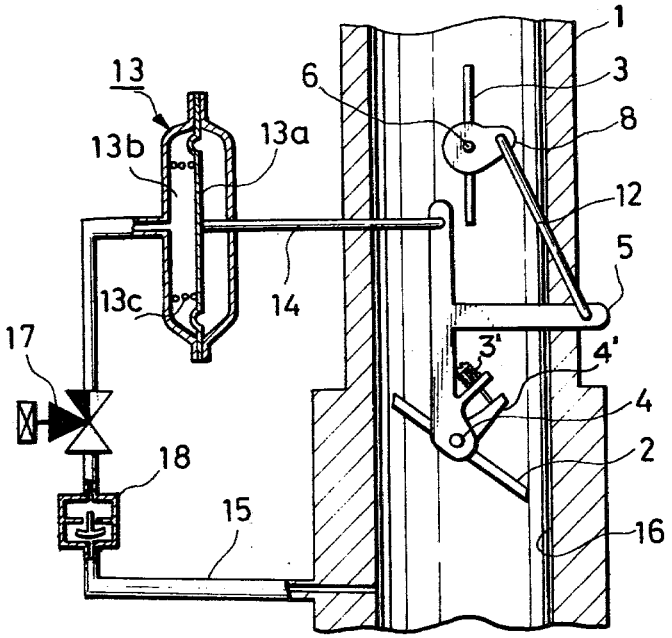
FIG. 1 is a vertical section of a portion of a carburetor and schematically shows one embodiment of an automatic choke of the present invention.
Figure 2:
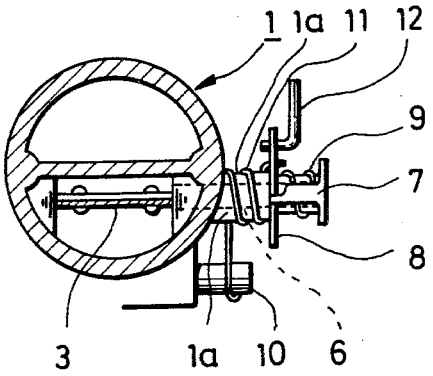
FIG. 2 is a partial section view in plan of the carburetor of FIG. 1 showing the choke valve.
Figure 3:
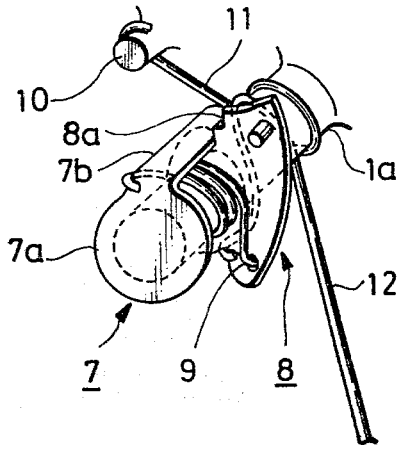
FIG. 3 is an enlarged oblique view showing a choke-closing spring and relief spring of the choke valve of FIG. 2.

FIGS. 1–3 illustrate a choke as one embodiment of the present invention, which is basically designed such that there is a stiff spring to close the choke valve; the temperature of the engine water, oil or the sucked air is sensed; and when this temperature attains a preset value, the choke valve is opened by the action of a diaphragm means or other fluid motor operated by the negative pressure or vacuum in the suction pipe of the engine.

To be more specific, 1 is the carburetor, 2 is the throttle valve and 3 is the choke valve. A rotatable shaft 4 of the throttle valve has an end which projects out of the wall of the carburetor 1 and to this projecting end is journalled, a first end of a fast idle lever 5 of essentially T-profile. A screw 3' attached to the end of the fast idle lever 5 is adjusted to a fast idle position, to open the throttle valve slightly wider than the normal idle position when fast idle lever 5 turns clockwise. Screw 3' engages an arm 4' secured to the throttle shaft to open the throttle valve to the fast idle position.

A choke shaft 6 of the choke valve 3 extends through a boss 1a on the wall of the carburetor 1 and has a projecting end to the tip of which an engaging piece 7 is secured to rotate together with the choke shaft 6. Engaging piece 7 has a circular plate portion **7*a* (FIG. 3) normal to the longitudinal direction of the choke shaft 6 and an arm 7*b* which is bent perpendicular to the circular plate portion 7*a* and extends longitudinally of the choke shaft 6**.

A choke lever 8 is rotatably mounted on the boss 1a. The choke lever 8 has a stepped portion **8*a* which engages an edge of the arm 7*b*. Wound around the boss 1a between the choke lever 8 and the circular plate portion 7a of the engaging piece 7 is a weak relief spring 9 which is connected between arm 7*b* and the choke lever 8 and weakly urges the choke valve 3 in the closing direction (clockwise in FIGS. 1 and 3) when choke lever 8 is turned clockwise. A projection 10 is formed at the appropriate position on the wall of the carburetor 1. Wound around the boss 1a between the choke lever 8 and the wall of the carburetor 1 is a stiff spring 11 which rotates choke lever 8 in a clockwise direction to close the choke through the action of spring 9. One end of spring 11 is hooked over projection 10 and the other end engages in a small hole in the choke lever 8 so that a strong force acts on the choke lever 8 to turn it clockwise. The choke lever 8 has a small hole at an appropriate position and into this hole goes a bent portion at one end of a rod 12, the other end of the rod being connected to a second end of the fast idle lever 5. A third end of the fast idle lever 5 is connected to a rod 14 which is attached to a diaphragm 13*a* in a choke return diaphragm unit 13. On the opposite side of the rod 14 from the diaphragm 13*a* is a negative pressure or vacuum chamber 13*b*, in which a spring 13*c* which urges the diaphragm 13*a* toward the rod 14 when there is no vacuum in chamber 13*b*. The chamber 13*b* communicates via the conduit path 15 with the engine suction in a throttle body or pipe 16 downstream of the throttle valve 2**.

In the conduit path 15 is a temperature sensing valve 17 and between the engine suction pipe 16 and the valve 17 is a check valve 18 which permits air flow from chamber 13b to suction pipe 16, but prevents reverse air flow from the engine suction pipe 16 to the negative pressure chamber 13b.

When a preset temperature of engine water, oil or suction air is sensed by the temperature sensing valve 17, the path 15 will be opened to communicate the negative pressure in the engine suction pipe into the negative pressure chamber 13b; but if the sensed temperature is lower than the preset value, the negative pressure chamber 13b will communicate with the atmosphere.

The sensing valve 17 may be any device which assures the above action and is here illustrated as a three-way valve, but it goes without saying that two two-way valves can be used to perform the same function as the three-way valve.

The operation of this first embodiment of the invention will now be described.

When the engine is cold i.e. cold start, the choke valve 3, being urged by the spring 11, choke lever 8, and spring 9, is in a closed state, while the throttle valve 2, is slightly opened by the fast idle lever 5. Thus the engine is provided with a rich fuel mixture for start up, and can run smoothly while cold.

Then warmup is begun. When the engine is not yet warm, the temperature sensing valve 17 connects the negative pressure chamber 13b with the atmosphere. In this condition the diaphragm 13a is urged by the spring 13c toward the rod 14, so that the fast idle lever 5 is urged in a clockwise direction to close the choke valve 3, thereby permitting a smooth warm-up. As the inlet air volume increases, however, the choke valve 3 can slightly open against the weak bias of the relief spring 9.

When the engine becomes warm enough and the engine temperature, i.e., the temperature of engine cooling water, engine oil or suction air exceeds the preset value, the temperature sensing valve 17 is switched to connect the negative pressure chamber 13b with the suction pipe 16, thereby causing a negative pressure or vacuum in the negative pressure chamber 13b. Upon introduction of the negative pressure into the negative pressure chamber 13b, the diaphragm 13a moves to the left in FIG. 1 thus compressing the spring 13c, and pulling on rod 14 thereby turning the fast idle lever 5 counter-clockwise to open the choke valve 3 and permit throttle valve 2 to close to the normal idle position. When the vehicle is driven and the throttle valve 2 opens, the pressure in the suction pipe 16 is approximately equal to the atmospheric pressure; but since the negative pressure in the negative pressure chamber 13b is held by the check valve 18, the choke valve 3 is maintained open. Thus the choke valve 3 is maintained open after warm-up, the engine suction is fully assured and the drivability does not drop.

If the engine is temporarily stopped so that the engine is still sufficiently hot that the temperature sensing valve 17 connects the negative pressure chamber 13b to the check valve 18, the negative pressure in the negative pressure chamber 13b is maintained by the check valve 18, thereby keeping the choke valve 3 open. Thus the engine is ready to restart smoothly.

When the engine is stopped for a long time, the engine temperature falls and the temperature sensing valve 17 is switched to communicate the negative pressure 13b with the atmosphere. Thereupon the pressure in the negative pressure chamber 13b becomes atmospheric and the choke valve 3 closes, bringing about the same condition as at cold start.

Figure 4:
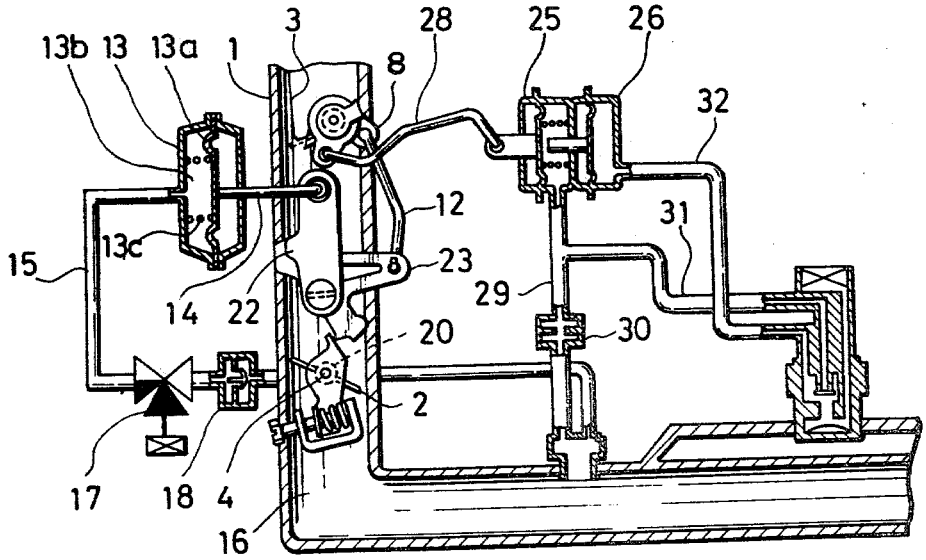
FIG. 4 is a view in schematic of another embodiment of an automatic choke of the present invention.
Figure 5:
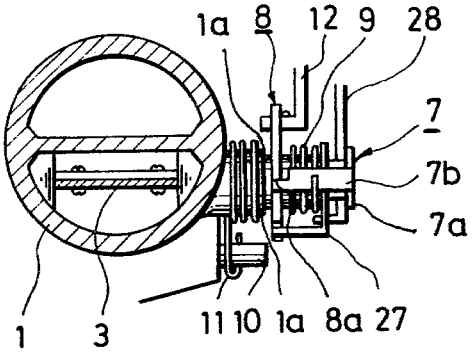
FIG. 5 is a partial section view in plan of the choke valve of FIG. 4.
Figure 6:
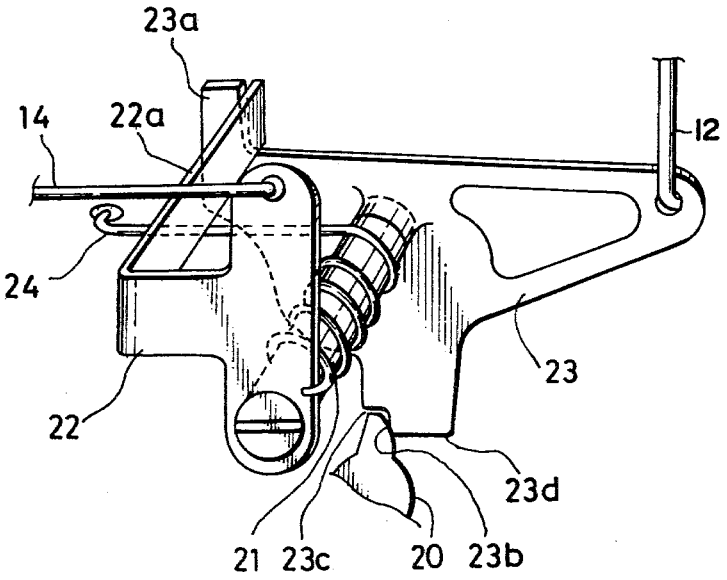
FIG. 6 is an enlarged oblique view showing a fast idle cam for the choke of FIG. 4.

FIGS. 4–6 illustrate a second embodiment, which combines the first embodiment with a choke breaker and a choke opener to further improve the drivability. In the explanation of the second embodiment, the same numerals are used to identify the corresponding elements of the embodiment of FIGS. 1–3.

In FIG. 4 a cam plate 20 is fixed to the end of the rotating shaft 4 of the throttle valve 2 which projects out of the carburetor wall, while the fast idle lever 22 and the fast idle cam 23 are rotatably mounted, as shown in FIG. 4, on a shaft 21 secured to or integral with the carburetor wall.

The fast idle cam 23 is urged clockwise in FIG. 4 by the spring 11, via the choke lever 8 and the rod 12. The fast idle lever 22 has an arm 22a being in the longitudinal direction of the shaft 21. The fast idle cam 23 has an abutment 23a which engages the arms 22a of fast idle lever 22. The fast idle lever 22 is urged by the spring 24 to turn in a counterclock direction, that is a direction to maintain the engagement between the bent arm 22a and the abutment 23a. One end of the fast idle lever 22 is connected to the rod 14 of the diaphragm unit 13.

In fast idle cam 23 is formed a step with edge 23b, on one side of which is a depression 23c, and on the other side of which is a projection 23d.

When the fast idle cam 23 turns clockwise, the tip of cam plate 20 is engaged by side edge 23b and is in the depression 23c at cold start. When the gas pedal is stepped on once to move the throttle valve the tip of cam plate 20 moves beyond the stepped portion 23b and seats on the projection 23d to maintain the throttle in a fast idle position. To release the cam plate 20 from the projection 23d the diaphragm 13a has to be pulled toward the negative pressure chamber 13b to forcibly turn the fast idle lever 22 in a counterclockwise direction, thereby rotating the fast idle cam 23 counterclockwise against the force of the choke closing spring 11 (the force of spring 11 is transmitted to fast idle cam 23 by rod 12 and choke lever 8, FIG. 5).

There is a slight difference from the first embodiment at the choke valve 3. For the purpose of transmitting the control force of a choke breaker 25 and a choke opener 26 to the choke valve 3, a force-transmitting plate 27 is rotatably mounted on the boss 1a between the engaging piece 7 and the choke lever 8, the plate 27 being partly bent in the longitudinal direction of the boss 1a to engage the choke lever 8 upon counterclockwise rotation of plate 27 (as viewed from the outer end of boss 1a). One end of a choke breaker rod 28 is connected to the choke breaker 25, while the other end of it goes into a small hole on plate 27, thereby transmitting the force from the choke breaker 25 to the choke valve 3 via rod 28, plate 27, choke lever 8, and engaging piece 7.

The choke breaker 25 communicates through the conduit path 29 via the throttle 30 with the suction path downstream of the throttle valve 2. The choke breaker 25 is coupled to the choke opener 26. The conduit path 29 and the choke opener 26 are connected respectively over the paths 31 and 32 to a bimetal vacuum switching valve (BVSV).

The operation of the second embodiment is virtually the same as the first embodiment and here is described mainly the difference between the two.

When the pressure in the negative pressure chamber 13a (FIG. 4) of the choke return diaphragm 13 is atmospheric, the fast idle lever 22 is turned clockwise by the spring 11; but the choke valve 3 does not fully close, because the fast idle cam 23 is interferred with by a link coupled with the throttle valve 2. When the gas pedal is stepped on, fast idle cam 23 is released, and the spring 11 causes the choke valve 3 to be fully closed, and at the same time causes the throttle cam plate 20 to climb out of the depression 23c of the fast idle cam 23 so that the throttle valve 2 is in its fast idle position when the gas pedal is released. Immediately after start up of the engine, the choke valve 3 is slightly opened by the choke breaker 25 which pulls rod 28 a slight distance to the right (FIG. 4) because of the vacuum in pipe 16. When the engine is warmed up to a certain extent, the BVSV operates to connect pipe 32 to pipe 31 so that vacuum in pipe 29 actuates the choke opener 26 which acts to forcibly open the choke valve 3 further, and at the same time the choke lever 8 turns fast idle cam 23 counterclockwise, slightly, so that the cam plate 20 is on a next step of fast idle cam 23 whereby a second fast idle open position of the throttle valve, slightly smaller than the above-mentioned fast idle position is attained. With further progress in warm-up, the temperature sensing valve 17 shifts to the high temperature side, whereupon the negative pressure of suction is transmitted to the choke return diaphragm 13 through pipe 15, and in consequence the fast idle and the choke valve 3 are released. Thus with the control by the choke breaker 25 and the choke opener 26 superposed on the control by the temperature sensing valve 17, the drivability is increased over that in the first embodiment.

In the automatic choke according to the present invention in which the choke valve is controlled by a temperature sensing valve, an expensive bimetal means such as a thermostat need not be used and a substantial cost reduction can be realized. Meanwhile in spite of the use of features of the conventional manual choke mechanism, the device functions as an automatic choke. Sufficient drivability is assured, but added use of a choke breaker and a choke opener further improves the drivability.

What is claimed is:

1. An automatic choke comprising:

a choke valve;

a choke lever connected to said choke valve through a choke shaft for opening and closing said choke valve;

a choke return diaphragm having a negative pressure chamber located on one side of said diaphragm;

link means connecting said diaphragm to said choke lever for rotation of the choke lever in response to movement of the diaphragm;

a spring engaging said choke lever to urge said choke valve in a direction to close the choke valve;

a temperature sensing valve in a conduit connecting said negative pressure chamber of said choke return diaphragm with a suction pipe downstream of a throttle valve, said temperature sensing valve comprising, means for connecting said negative pressure chamber to atmosphere when the temperature sensed is lower than a preset value, so that the spring urges the choke valve closed, and means for connecting said negative pressure chamber with said suction pipe when the temperature sensed is higher than the preset value, so that a negative pressure in the suction pipe is introduced into said negative pressure chamber to move said diaphragm and choke lever against the action of the spring to a position to open the choke valve; and, check valve means located in the conduit between said temperature sensing valve and said suction pipe for preventing loss of a negative pressure in said negative pressure chamber through said suction pipe.

2. Automatic choke of claim 1, wherein the connection between said choke shaft and said choke lever comprises an engaging piece which includes a circular plate fixed to said choke shaft and in a plane normal to the axis of said choke shaft and an arm bent normal to said circular plate and engaging said choke lever.

3. Automatic choke of claim 2, wherein a relief spring less stiff than said spring for closing the choke is connected between said choke lever and said choke shaft.

4. Automatic choke of claim 1, wherein said link means connecting said diaphragm and choke lever comprises, a fast idle lever having a first portion linked to said diaphragm and a second portion linked to said choke lever so that said choke lever and said diaphragm are interlocked with each other.

5. Automatic choke of claim 1, wherein said temperature sensing valve senses a temperature selected from the group consisting of engine water temperature, engine oil temperature and sucked air temperature, and comprises, a three-way valve.

6. An automatic choke comprising:

a choke valve;

a choke lever connected to said choke valve through a choke shaft for opening and closing said choke valve;

a choke return diaphragm having a negative pressure chamber located on one side of said diaphragm;

link means connecting said diaphragm to said choke lever for rotation of the choke lever in response to movement of the diaphragm;

a spring engaging said choke lever to urge said choke valve in a direction to close the choke valve;

a temperature sensing valve in a conduit connecting said negative pressure chamber of said choke return diaphragm with a suction pipe downstream of a throttle valve, said temperature sensing valve comprising, means for connecting said negative pressure chamber to atmosphere when the temperature sensed is lower than a preset value, so that the spring urges the choke valve closed, and means for connecting said negative pressure chamber with said suction pipe when the temperature sensed is higher than the preset value, so that a negative pressure in the suction pipe is introduced into said negative pressure chamber to move said diaphragm and choke lever against the action of the spring to a position to open the choke valve;

check valve means located in the conduit between said temperature sensing valve and said suction pipe for preventing loss of a negative pressure in said negative pressure chamber through said suction pipe;

choke breaker means connected to said choke lever to open said choke valve to a first cold engine position;

choke opener means connected to said choke lever to open said choke valve to a second cold engine position different from said first position; and, both said positions being close to a closed choke position.

7. Automatic choke of claim 6, wherein the connection between said choke shaft and said choke lever comprises an engaging piece which includes a circular plate fixed to said choke shaft and in a plane normal to the axis of said choke shaft and an arm bent normal to said circular plate and engaging said choke lever.

8. Automatic choke of claim 6, wherein the connection between said choke lever and said choke breaker comprises a force-transmitting plate rotatably mounted on a boss and movable by the choke breaker to engage said choke lever.

9. Automatic choke of claim 6, wherein a relief spring less stiff than the spring for closing the choke valve is interposed between said choke lever and said choke shaft.

10. Automatic choke device of claim 6, wherein said link means connecting said diaphragm and choke lever includes a fast idle cam rotatable around a shaft fixed to an outer wall of a carburetor, said fast idle cam having a first choke lever via a rod, a second end engaging a cam plate rotatably interlocked with a throttle valve, and a third end engaging a fast idle lever which is rotatable around said shaft, the fast idle lever having an end connected to said diaphragm via a rod, and a bent arm engaging said fast idle cam.

11. Automatic choke device of claim 10, further comprising a spring for urging said fast idle lever to engage said fast idle cam.

12. Automatic choke of claim 10, wherein the engagement between said fast idle cam and said cam plate is at a stepped part of the fast idle cam.

13. Automatic choke of claim 6, wherein said temperature sensing valve senses a temperature selected from the group consisting of engine water temperature, engine oil temperature and sucked air temperature, and comprises, a three-way valve.

* * * * *